US006278428B1

(12) United States Patent
Smith et al.

(10) Patent No.: US 6,278,428 B1
(45) Date of Patent: Aug. 21, 2001

(54) DISPLAY PANEL

(75) Inventors: Ronald D. Smith, Phoenix; Anthony C. Miller, Gilbert, both of AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/275,615

(22) Filed: Mar. 24, 1999

(51) Int. Cl.[7] ..... G09G 3/36
(52) U.S. Cl. ..... 345/92; 345/98
(58) Field of Search ..... 345/103, 98, 55, 345/90, 94, 56, 204, 92

(56) References Cited

U.S. PATENT DOCUMENTS 5,017,914 * 5/1991 Uchida et al. ..... 340/784
5,157,386 * 10/1992 Uchida et al. ..... 340/784
5,192,945 * 3/1993 Kusada ..... 340/784
5,325,106 * 6/1994 Bahraman ..... 345/56
5,426,447 * 6/1995 Lee ..... 345/103
5,459,483 * 10/1995 Edwards ..... 345/98
5,712,652 * 1/1998 Sato et al. ..... 345/90
5,757,351 * 5/1998 Lin et al. ..... 345/98
6,005,558 * 12/1999 Hudson et al. ..... 345/204
6,064,362 * 5/2000 Brownlow et al. ..... 345/98
6,067,065 * 5/2000 Worley, III et al. ..... 345/94

* cited by examiner

*Primary Examiner*—Steven Saras
*Assistant Examiner*—Srilakshmi Kumar
(74) *Attorney, Agent, or Firm*—Trop, Pruner & Hu, P.C.

(57) ABSTRACT

A system includes an array of pixel cells, column lines, storage elements and decoding circuitry. The pixel cells are arranged in rows and columns and the column lines are associated with the column pixel cells. The storage elements are associated with a row of the pixel cells. The decoding circuitry is adapted to storage charges on the column lines and after the storage, transfer the charges from the column lines to the storage elements.

29 Claims, 6 Drawing Sheets

CLK
TIME

ROWX
TIME

COL0
TIME

COLM
TIME

CLK
TIME

ENCOL0
TIME

ENCOLM
TIME

VIDEO_IN
COL. ZERO
COL. ONE
COL. M
TIME

ROWX, COL0-COLM
TIME

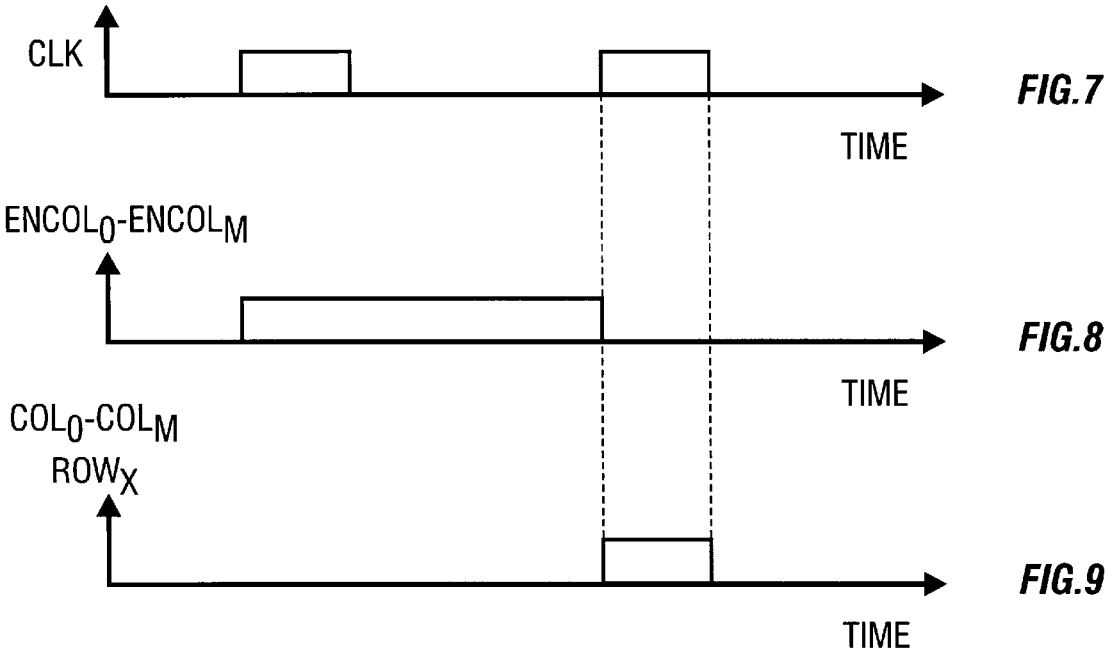
FIG.7
FIG.8
FIG.9
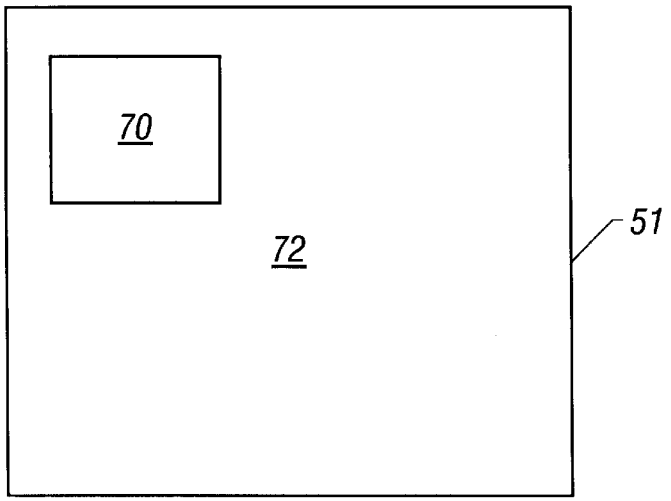
FIG.15

DISPLAY PANEL

BACKGROUND

The invention generally relates to an optical display device, and more particularly, the invention relates to a display panel, such as an active matrix liquid crystal display (LCD) panel, for example.

Referring to FIG. 1, an active matrix liquid crystal display (LCD) panel 1 may include an array 6 of pixel cells 25 (arranged in rows and columns) that form corresponding pixels of an image. To accomplish this, each pixel cell 25 typically receives an electrical voltage that controls optical properties of the pixel cell 25 and thus, controls the perceived intensity of the corresponding pixel. If the pixel cell 25 is a reflective pixel cell, the level of the voltage controls the amount of light that is reflected by the pixel cell 25.

There are many applications that may use the display panel 1. For example, a color projection display system may use three of the display panels 1 to modulate red, green and blue light beams to produce a projected multicolor composite image. As another example, a display screen for a laptop computer may include a display panel 1 along with red, green and blue color filters that are selectively mounted over the pixel cells to produce a multi-color image.

Regardless of the use of display panel 1, updates are continually made to the voltages of the pixel cells 25 to refresh or update the displayed image. More particularly, each pixel cell 25 may be part of a different display element 20 (a display element 20*a,* for example), a circuit that stores a charge that indicates the voltage for the pixel cell. The charges that are stored by the display elements 20 typically are updated (via row 4 and column 3 decoders) in a procedure called a raster scan. The raster scan is sequential in nature, a designation that implies the display elements 20 are updated in a particular order such as from left-to-right or from right-to-left.

As an example, a particular raster scan may include a left-to-right and top-to-bottom "zig-zag" scan of the array 8. More particularly, the display elements 20 may be updated one at a time, beginning with the display element 20*a* that is located closest to the upper left comer of the array 6 (assuming the display panel 1 is standing upright). During the raster scan, the display elements 20 are individually and sequentially selected (for charge storage) in a left-to-right direction across each row, and the updated charge is stored in each display element 20 when the display element 20 is selected. After each row is scanned, the raster scan advances to the leftmost display element 20 in the next row immediately below the previously scanned row.

During the raster scan, the selection of a particular display element 20 may include activating a particular row line 14 and a particular column line 16, as the rows of the display elements 20 are associated with row lines 14 (row line 14*a,* as an example), and the columns of the display elements 20 are associated with column lines 16 (column line 16*a,* as an example). Thus, each selected row line 14 and column line 16 pair uniquely addresses, or selects, a display element 20 for purposes of transferring a charge (in the form of a voltage) from a video signal input line 12 to a capacitor 24 (that stores the charge) of the selected display element 20.

As an example, for the display element 20*a* that is located at pixel position (0,0) (in Cartesian coordinates), a voltage may be applied to the video signal input line 12 (at the appropriate time) that indicates a new charge that is to be stored in the display element 20*a*. To transfer this voltage to the display element 20*a,* the row decoder 4 may assert (drive high, for example) a row select signal (called $ROW_0$) on a row line 14*a* that is associated with the display element 20*a,* and the column decoder 3 may assert a column select signal (called $COL_0$) on column line 16*a* that is also associated with the display element 20*a*. In this manner, the assertion of the $ROW_0$ signal may cause a transistor 22 (of the display element 20*a*) to couple a capacitor 24 (of the display element 20*a*) to the column line 16*a*. The assertion of the $COL_0$ signal may cause a transistor 18 to couple the video signal input line 12 to the column line 16*a*. As a result of these connections, the charge that is indicated by the voltage of the video signal input line 12 is transferred to the capacitor 24 of the display element 20*a*. The other display elements 20 may be selected for charge updates in a similar manner.

Referring also to FIGS. 2, 3, 4 and 5, a row of the display elements 20 may be scanned in the following manner. First, the row decoder 4 continuously asserts (drives high, for example) the $ROW_X$ signal (the $ROW_0$, $ROW_1$, . . . or $ROW_N$ signal, as examples) that is associated with the particular row. While the $ROW_X$ signal remains asserted, the display elements 20 of the selected row are sequentially selected in column order to receive a time slice of the voltage of the video signal input line 12. In this manner, the column decoder 3 individually and sequentially asserts (drives high, for example) the COL column select signals (the $COL_O$, $COL_1$, . . . and $COL_M$ signals, as examples), as depicted in FIGS. 4 and 5 for the $COL_0$ and $COL_M$ signals, while the row decoder 4 keeps the $ROW_X$ signal asserted. The selection of each display element 20 (and the associated charge transfer) may consume a cycle of a clock signal (called CLK and shown in FIG. 2). Thus, a scan of M (i.e., the number of columns) display elements 20 of a row may consume approximately M clock cycles.

In the above-described approach, all of the display elements 20 are sequentially and individually selected according to a predefined raster scan sequence, a technique that may limit the rate at which a particular portion of the array 6 may be updated. For example, the display 1 may be used to display picture frames of a video image, and between two successive frames, some portions of the image may change more rapidly than other parts of the image. Unfortunately, the maximum rate at which the more rapidly changing portions may be updated may be limited by the rate at which the raster scan is performed. As a result, temporal artifacts, or errors, in the video image may be more apparent in the more rapidly changing portions of the image.

Thus, there is a continuing need for an arrangement that addresses one or more of the above-stated problems.

SUMMARY

In one embodiment of the invention, a method includes storing charges on different column lines that are associated with an array of pixel cells. After the storing, the charges are transferred from the column lines to storage elements that are associated with some of the pixel cells.

In another embodiment, a method for updating a portion of a display includes selecting columns of pixel cells that are associated with the portion and selecting rows of pixel cells that are associated with the portion. For each selected row of pixel cells, charges are stored on column lines that are associated with the selected columns of pixel cells, and after the storage, the charges are used to update the selected row.

In another embodiment, a display includes an array of pixel cells, storage elements, column lines, video input lines and switches. The pixel cells of the array are arranged in rows of pixel cells and columns of pixel cells. Each storage element is associated with one of the pixel cells. The column lines are associated with the columns of pixel cells, and each video input line is associated with one of the column lines and adapted to transfer charge to the associated column line. The switches are selectively controlled to transfer charges between the video input lines and the column lines.

In another embodiment, a display includes a first group of pixel cells and a second group of pixel cells. The first group of pixel cells is adapted to indicate a portion of a current frame of a video image and be updated in response to a subsequent frame of the video image. The second group of pixel cells is adapted to indicate another portion of the current frame video image and not be updated in response to the subsequent frame.

In yet another embodiment, a system includes an array of display pixel cells, column lines, storage elements and decoding circuitry. The pixel cells are arranged in rows and columns, and the column lines are associated with the columns of pixel cells. The storage elements are associated with one of the rows of the pixel cells. The decoding circuitry is adapted to storage charges on the column lines and after the storage, transfer the charges from the column lines to the storage elements.

BRIEF DESCRIPTION OF THE DRAWING

FIGS. 7, 8 and 9 are waveforms illustrating operation of the display panel of FIG. 6 according to an embodiment of the invention.

FIG. 15 is an illustration of a raster scanning technique for use with the display panel of FIG. 6.

DETAILED DESCRIPTION

Figure 1:
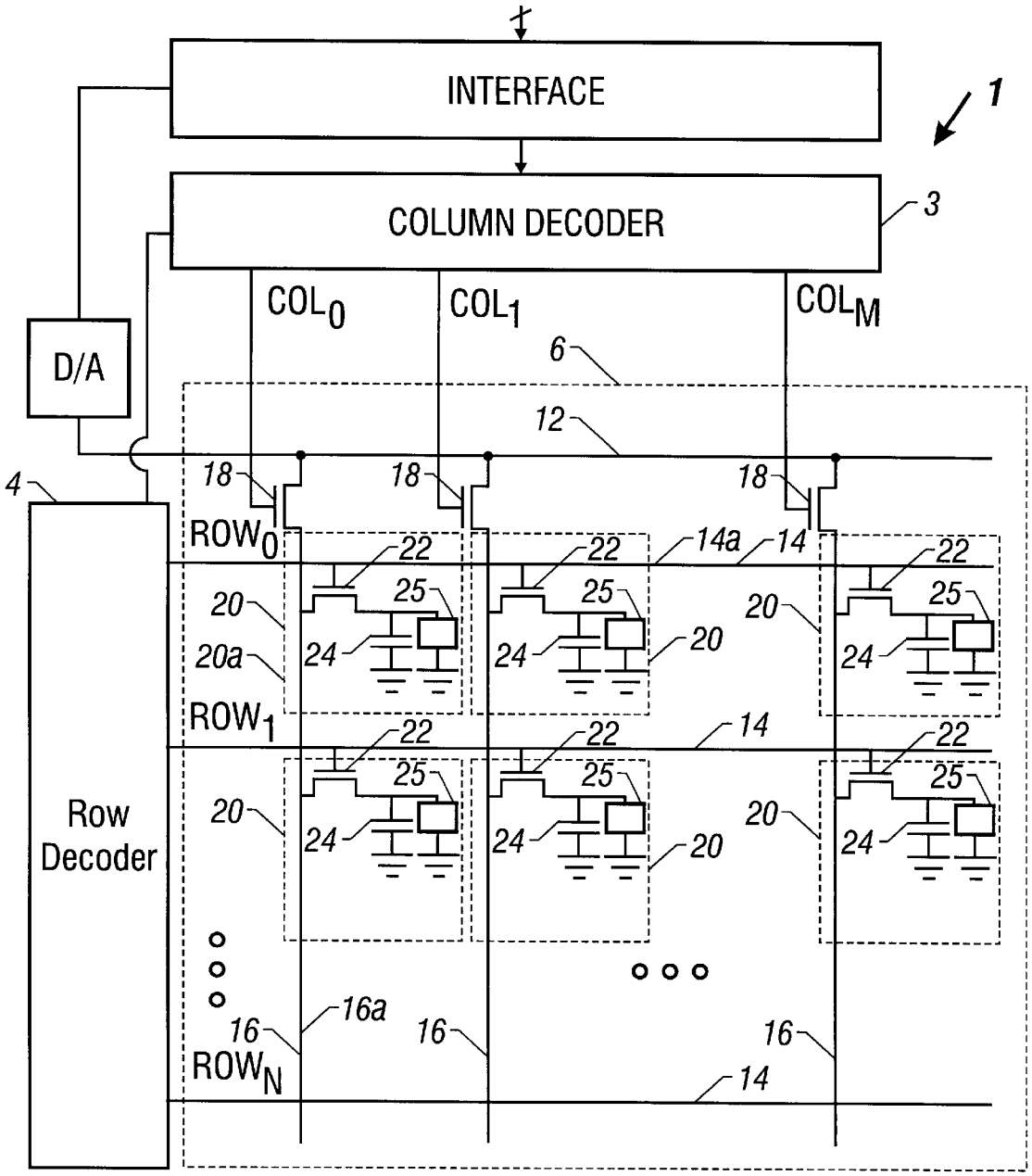
FIG. 1 (PRIOR ART)
FIG. 1 is a schematic diagram of a display panel of the prior art.
Figures 2, 3, 4, 5, 10, 11, 12, 13, 14:
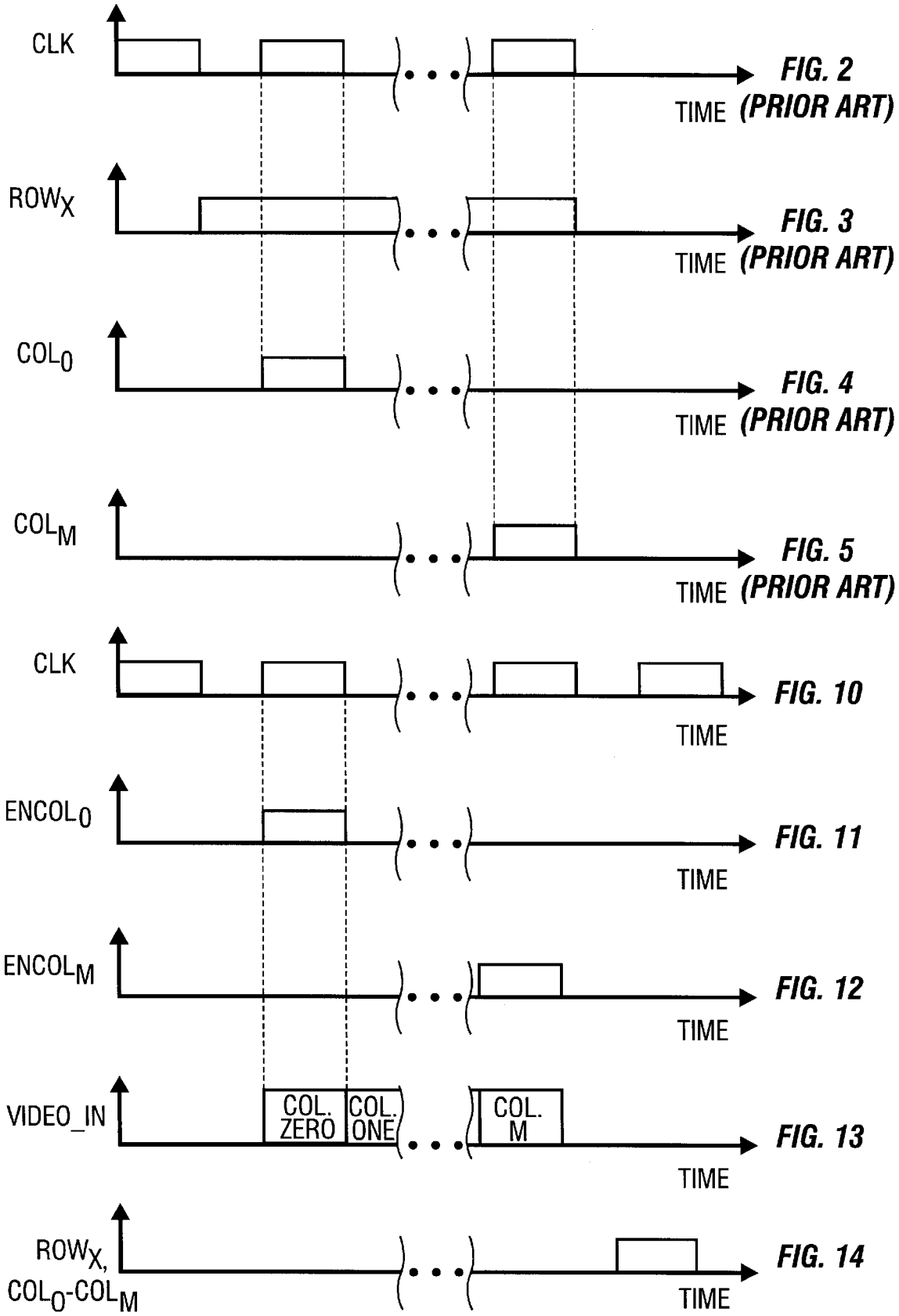
FIG. 2 (PRIOR ART)
FIG. 3 (PRIOR ART)
FIG. 4 (PRIOR ART)
FIG. 5 (PRIOR ART)
FIGS. 2, 3, 4 and 5 are waveforms illustrating signals associated with the display panel of FIG. 1.
FIGS. 10, 11, 12, 13 and 14 are waveforms illustrating operation of the display panel of FIG. 6 according to another embodiment of the invention.
Figure 6:
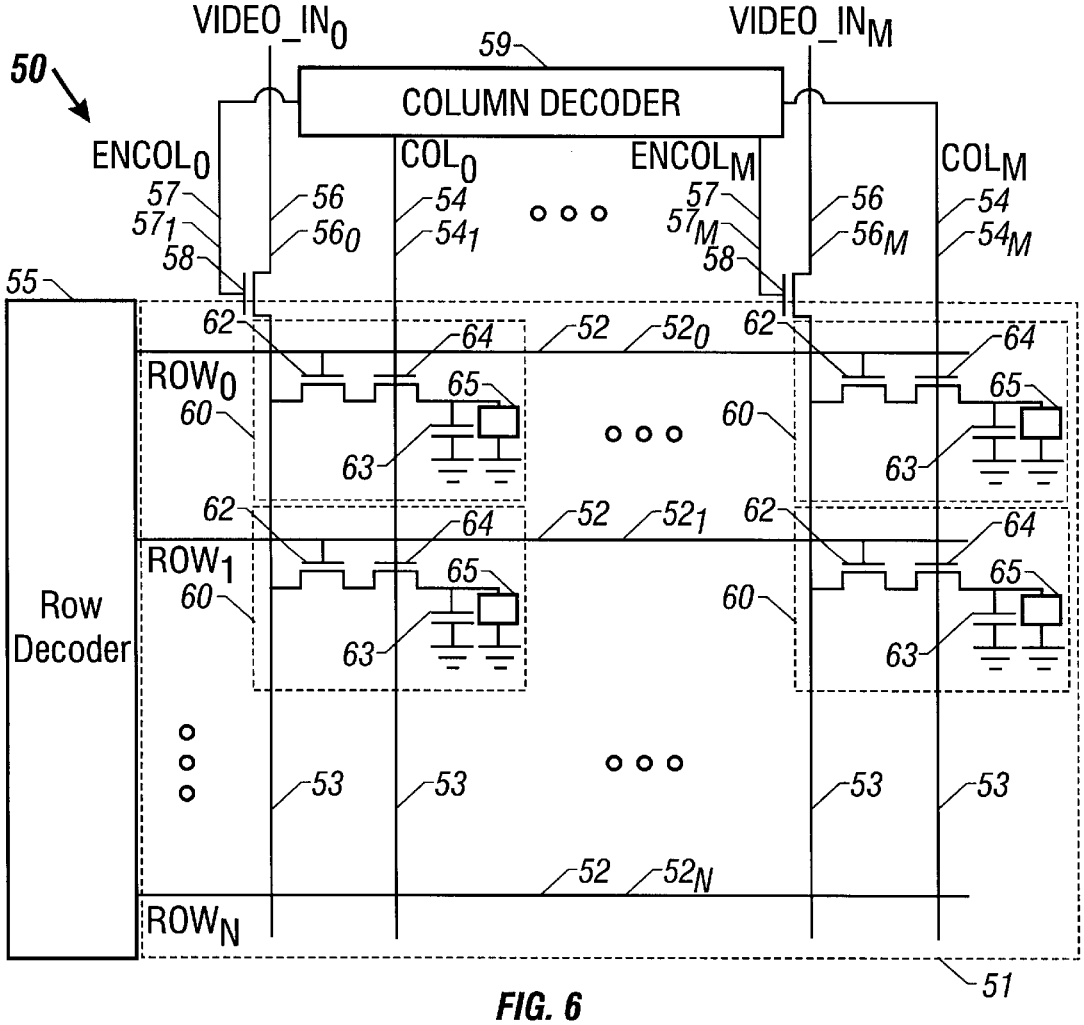
FIG. 6 is a schematic diagram of a display panel according to an embodiment of the invention.

Referring to FIG. 6, an embodiment 50 of a display panel in accordance with the invention includes an array 51 of pixel cells 65 that may be arranged in rows and columns. Each pixel cell 65, in turn, may be part of a display element 60, a circuit that stores a charge that indicates an intensity of a pixel (of an image) that is formed by the pixel cell 65. The rows of pixel cells 65 may be associated with row select lines 52 (lines $\mathbf{52}_0$, $\mathbf{52}_1$, . . . $\mathbf{52}_N$, as examples), and the columns of pixel cells 65 may be associated with column select lines 54 (lines $\mathbf{54}_0$, $\mathbf{54}_1$, . . . $\mathbf{54}_M$, as examples). Each combination of a row select line 52 and a column line select 54 may uniquely address one of the display elements 60 to update the charge that is stored by the display element 60.

For purposes of updating the charges (to compensate for charge leakage or to change the intensity of the pixels), a conventional display panel may select the display elements pursuant to a raster scan in which the charges are updated by sequentially and individually addressing, or selecting, the display elements. However, unlike conventional arrangements, in some embodiments, the display panel 50 may be adapted to substantially simultaneously update the charges stored by several (all, for example) of the display elements 60 of a particular row. This feature may permit faster raster scans of the display 50 and thus, faster updates to images that are formed by the display panel 50, as further described below. Thus, in some embodiments, the display elements 60 may be effectively scanned one row at a time instead of being scanned individually.

Furthermore, in some embodiments, specific columns of display elements 60 may be selected and other columns of display elements 60 may be deselected for purposes of the raster scan, a feature that permits more frequent updates to selected portions of the array 51 and less frequent updates to other portions of the array 51, as described below. Unless otherwise specifically described below, it is assumed for purposes of discussion that all display elements 60 of a particular row are selected, i.e., all columns are selected for the raster scan.

To update the charges that are stored by a particular row of display elements 60, column lines 53 may be used to temporarily store the charges. Each column line 53 is associated with a particular column of display elements 60, and the column lines 53 initially receive the update charges, i.e., the charges to replace the charges that are currently stored by the display elements 60 of the particular row. As described below, the column lines 53 may simultaneously or sequentially (as examples) receive the charges for the row, and each column line 53 stores the charge via the capacitance that is associated with the column line 53. The capacitance of each column line 53 may be attributed to the inherent capacitance of the column line 53 or to a combination of the inherent capacitance of the column line 53 and the capacitance contributed by one or more explicit capacitors that are coupled to the column line 53.

After the charges are stored on the column lines 53, circuitry (of the display elements 60, described below) transfers the charges from the column lines 53 to the display elements 60 (of the particular row) to replace, or update, the charges previously that were previously stored by the display elements 60. These updates, in turn, update the intensities of the corresponding pixels of the image that is formed by the display panel 50.

In some embodiments, the column lines 53 may receive the charges in a substantially simultaneous manner, a feature that permits updates to a particular row of display elements 62 in a relatively few (two, for example) number of clock cycles, as compared to approximately M clock cycles that may be used in a conventional display panel to update M display elements. For example, each column line 53 may be selectively coupled to a different video signal input line 56 (lines $\mathbf{56}_0$ . . . $\mathbf{56}_M$, as examples) via an associated switch, such an n-channel metal-oxide-semiconductor field-effect-transistor (nMOSFET) 58. For a particular time slice, each video input line 56, in turn, provides a voltage that indicates the charge to be ultimately stored in one of the display elements 60. More particularly, the transistors 58 may be selectively activated to couple the video input lines 56 to the column lines 53 via enable signals called ENCOL ($\mathrm{ENCOL}_0$, . . . $\mathrm{ENCOL}_M$ signals, as examples). As a result of this arrangement, during a particular cycle of a clock signal (called CLK and depicted in FIG. 7), a column decoder 59 (see FIG. 6) may collectively assert (drive high, for example) the $\mathrm{ENCOL}_0$–$\mathrm{ECOL}_M$ signals to store the charges on the column lines 53 of the entire row, as depicted in FIG. 8. During the next cycle of the CLK signal, the $ROW_X$ signal for the row being updated and the $COL_0$–$COL_M$ signals are asserted (driven high, for example), as depicted in FIG. 9 to complete the transfer of charges to the display elements 60.

Referring back to FIG. 6, in some embodiments, to perform the transfer of charges from the column lines 53 to the display elements 60, each display element 60 may include two nMOSFETs 62 and 64 that have their drain-source paths serially coupled together between the associated column line 53 and a capacitor 63, a device that stores the charge for the display element 60. The gate terminal of the transistor 62 is coupled to the associated row select line 52, and the gate terminal of the transistor 64 is coupled to he associated column select line 54. Therefore, when the row select 52 and column elect 54 lines that are associated with a particular display element 60 are asserted (driven high, for example), the capacitor 63 of the display element 60 is coupled to the associated column line 53 to receive charge from the column line 53.

Before the charge transfer, the capacitor 63 stores a charge, and in effect, charge sharing occurs between the capacitor 63 and the column line 53. However, the capacitance of the column line 53 may be much larger (100 times larger, for example) than the capacitance of the capacitor 63, a condition that permits the voltage of the column line 53 to override the voltage of the capacitor 63.

Other embodiments are possible. For example, referring to FIGS. 10, 11, 12, 13 and 14, in some embodiments, the video signal input lines 56 may be coupled together to effectively form a single video signal input line that indicates the voltages (via a signal called VIDEO_IN) for the different column lines 53 in a time multiplexed fashion. As an example, during a first cycle of the CLK signal, the $ENCOL_0$ signal is asserted (driven high, for example) while the remaining $ENCOL_1$–$ENCOL_M$ signals are deasserted (driven low, for example) to couple just the column line $\mathbf{53}_0$ to the VIDEO_IN signal. During this clock cycle, the VIDEO_IN signal indicates the charge to be stored on the column line $\mathbf{53}_0$. During the next cycle of the CLK signal, the $ENCOL_1$ signal is asserted (driven high, for example) while the remaining $ENCOL_0$ $ENCOL_2$–$ENCOL_M$ signals are deasserted (driven low, for example) to couple just the column line $\mathbf{53}_1$ to the VIDEO_IN signal. Charges are sequentially stored on the remaining column lines $\mathbf{53}_2$–$\mathbf{53}_M$ in a similar manner during subsequent cycles of the CLK signal. After the charges are stored on the column lines $\mathbf{53}_0$–$\mathbf{53}_M$, the $ROW_X$ signal for the selected row is asserted and the $COL_0$–$COL_M$ signals are collectively asserted to transfer the charges from the column lines $\mathbf{53}_0$–$\mathbf{53}_M$ to the display elements 60 of the row.

Referring to FIG. 15, in some embodiments, the display panel 50 may be used to form picture frames of a video image, and as described further below it may be advantageous to update a portion 70 of the pixel cells 65 of the array 51 at a faster rate than the remaining portion 72. As an example, the entire array 51 (including the portion 70) may be updated at 60 Hz (as an example), and the portion 70 may be updated at 120 Hz (as an example), i.e., the portion 70 may be updated in between updates for the entire array 51. During the 120 Hz update, the selection of the portion 70 and the deselection of the portion 72 is accomplished by the column decoder 59 asserting the appropriate COL and ENCOL signals to select just the columns that are associated with the portion 70. In this manner, during the 120 Hz updates, the row decoder 55 selectively asserts the ROW select signals that are associated with the portion 72 to individually and sequentially update rows of the display elements 60. In some embodiments, during the 60 Hz updates, the column decoder 59 selects all of the columns of the array 51, and the row 55 decoder individually and sequentially selects the rows of the entire array 51. During the 120 Hz updates, the column decoder 59 asserts the ENCOL signals that are associated with the portion 72 and deasserts the remaining ENCOL signals to conserve energy by preventing the remaining column lines 53 from being charged.

Although the portion 70 is depicted in FIG. 15 as being rectangular, the portion may assume many different shapes. Furthermore, several portions, of possibly different sizes and shapes, may be updated at a faster rate than the rate at which the entire array 51 is updated. Other update rates are possible and are within the scope of the appended claims.

Figure 16:
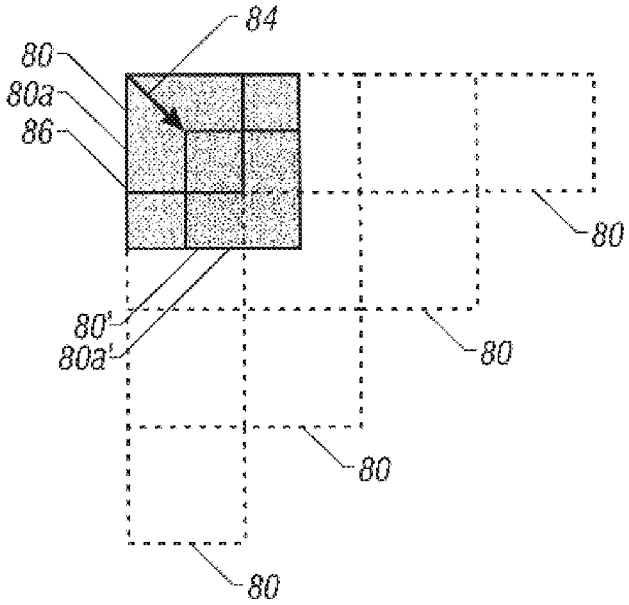
FIG. 16 is an illustration of block motion encoding for digital video.

Referring to FIG. 16, in some embodiments, the boundaries of the portion 70 may be derived from a digitally encoded video standard. In this manner, digitally encoded standards for storing digital audio and video signals include those from the Moving Picture Experts Group (MPEG), including the MPEG-2 standard. The MPEG-2 standard is described in ISO/IEC 13818-1 (MPEG-2 Systems), ISO/IEC 13818-2 (MPEG-2 Video), and ISO/IEC 13818-3 (MPEG-2 Audio), dated in 1994 and provided by the International Organization For Standardization (ISO) and the International Electrotechnical Commission (IEC). MPEG-2 provides a generic coding technique for moving pictures and associated sound of various applications, including digital storage media, television transmissions, and data communications. MPEG-2 also provides for representations of both progressive and interlaced scanned video sources. Video and audio data coded according to MPEG-2 may be manipulated as digital data, stored on various storage media, transmitted and received over networks, and/or distributed on transmission channels. Although reference is made to MPEG-2 picture frames in this description, the invention is not to be limited in this respect as other types of digitally encoded video standards may be used in further embodiments.

As an example, the MPEG-2 standard subdivides the video image into macroblocks 80 (a macroblocks 80*a,* as an example). For successive frames, a motion vector 84 indicates the new positions of the block(s) 80 that have moved from one frame to the next. For example, a macroblock 80*a* in a current picture frame of a video image frame may move to become a macroblock 80*a*' in a subsequent picture frame. This movement, in turn, causes a region 86 of the video image to change, and the display elements 60 that correspond to the region 86 may form the portion 70 that is updated.

Figure 17:
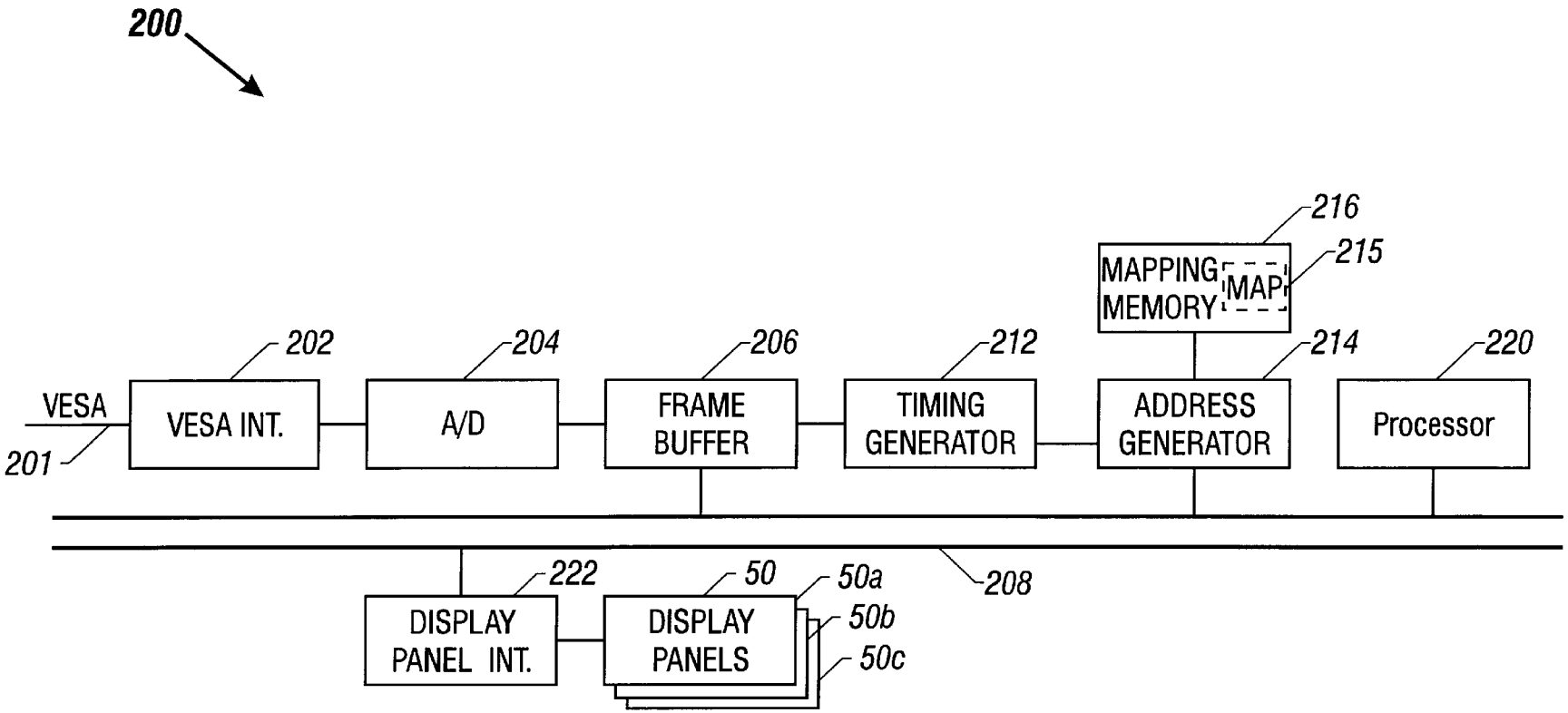
FIG. 17 is a schematic diagram of a projection system according to an embodiment of the invention.

Referring to FIG. 17, as an example, the display panel 50 may be used in a projection system 200 that includes three display panels 50*a* 50*b* and 50*c,* all of which may have a similar design to the display panel 50. The projection system 200 may be part of a computer system, for example, or part of a stand-alone projector. In particular, the projection system 200 may include a Video Electronics Standards Association (VESA) interface 202 to receive analog signals from a VESA cable 201. The VESA standard is further described in the Computer Display Timing Specification, v.1, rev. 0.8 that is available on the Internet at www.vesa.org/standards.html. These analog signals may indicate images to be formed on a projection screen and may be generated by a graphics card of a computer, for example. The analog signals are converted into digital signals by an analog-to-digital (A/D) converter 204, and the digital signals are stored in a frame buffer 206. A timing generator 212 may be coupled to the frame buffer 206 and regulate a frame rate at which images are formed on the projection screen. A processor 220 (one or more central processing units (CPUs), microcontrollers or microprocessors, as examples) may be coupled to the frame buffer 206 via a bus 208.

The processor 220 may analyze the received data to determine which portion(s) 70 of the array 51 are to be updated at the faster rate. The processor 220 may also process the data stored in the frame buffer 206 to, as examples, transform the coordinate space used by the graphics card into the coordinate space used by the display panels 50*a,* 50*b* and 50*c;* remap the color space used by the graphics card into the color space used by the display panels 50*a,* 50*b* and 50*c;* and cause the data to conform to the gamma function of the display panels 50*a,* 50*b* and 50*c.* The end product of these operations is a set of RGB values for each pixel of the image. In this manner, the R values may be used to form the intensity values of the pixels of the display panel 50*a,* the G values may be used to form the intensity values of the pixels of the display panel 50*c* and the B values may be used to form the intensity values of the pixels of the display panel 50*b.*

Not all of the pixels of a particular display panel 50*a,* 50*b* or 50*c* may be used. Instead, a map 215 may be stored in a mapping memory 216 that indicates the desired mapping transformation. The map 215, in turn, may be used by an address generator 214 that generates the pixel addresses for pixels of the display panels 50*a,* 50*b* and 50*c.*

Among the other features of the projection system 200, the system 200 may include a display panel interface 222 that is coupled to the bus 208 and drives the display panel voltages to form the images on the display panels 50*a,* 50*b* and 50*c* in response to signals that are furnished by the address generator 214.

Figure 18:
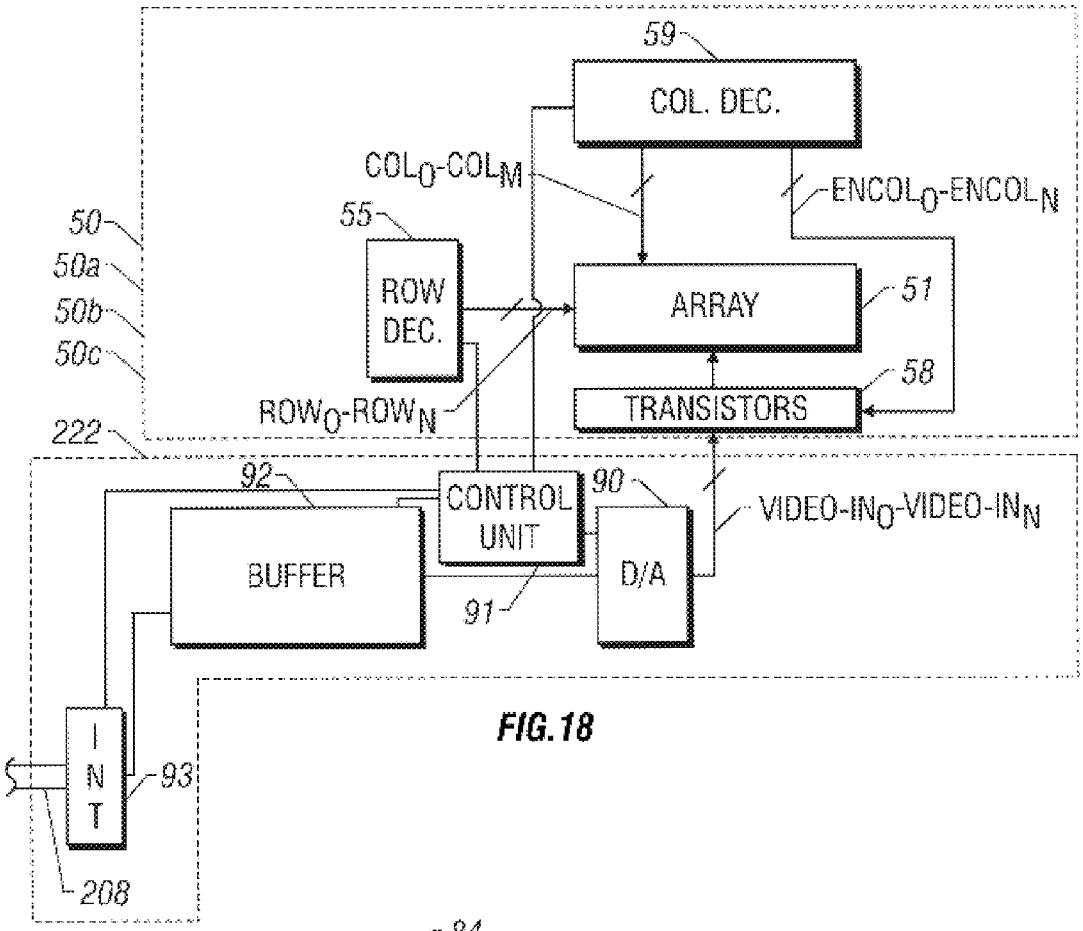
FIG. 18 is a more detailed schematic diagram of a display panel interface of FIG. 17.

Referring to FIG. 18, the display panel interface 222 may include a bus interface 93 that couples a buffer 92 to the bus 208. The buffer 92, in turn, stores digital video data that is received from the bus 208. The video data is converted into the $VIDEO_IN_0$–$VIDEO_IN_N$ signals by a digital-to-analog (D/A) converter 90. A control unit 91 coordinates the above-described activities of the display panels 50*a,* 50*b* and 50*c* and the display panel interface 222.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A method comprising:

storing charges on different column lines associated with an array of pixel cells; and after the storing, transferring the charges from the column lines to storage elements associated with some of the pixel cells.

2. The method of claim 1, wherein said some of the pixel cells are associated with a common row line.

3. The method of claim 1, wherein the act of transferring comprises:

simultaneously transferring the charges to the storage elements.

4. The method of claim 1, wherein the act of storing comprises:

sequentially driving the column lines with sampled indications of a video signal.

5. The method of claim 1, wherein the act of storing comprises:

simultaneously driving the column lines with sampled indications of a video signal.

6. A method for updating a portion of a display, comprising:

selecting columns of pixel cells that are associated with the portion;

selecting rows of pixel cells that are associated with the portion; and for each selected row of pixel cells, storing charges on column lines associated with the selected columns of pixel cells and after the storage, using the charges to update the selected row.

7. The method of claim 6, wherein the act of using comprises:

transferring the charges from the column lines to storage elements associated with the selected row.

8. The method of claim 7, wherein the act of transferring comprises:

simultaneously transferring the charges to the storage elements.

9. The method of claim 6, further comprising:

basing the selection on a video signal capable of indicating the portion.

10. A system comprising:

an array of display pixel cells arranged in rows and columns;

column lines associated with the columns of pixel cells;

storage elements associated with a row of the pixel cells; and decoding circuitry adapted to:

store charges on the column lines, and after the storage, transfer the charges from the column lines to the storage elements.

11. The system of claim 10, wherein the decoding circuitry is further adapted to:

simultaneously transfer the charges from the column lines to the storage elements.

12. The system of claim 10, wherein the decoding circuitry is further adapted to:

sequentially drive the column lines with sampled indications of a video signal.

13. The system of claim 10, wherein the decoding circuitry simultaneously drives the column lines with sampled indications of a video signal.

14. The system of claim 10, wherein the decoding circuitry simultaneously drives the column lines with sampled indications of a video signal.

15. A method comprising:

storing charges on different column lines associated with an array of pixel cells;

isolating said different column lines from storage elements associated with at least one of the pixel cells during the storing; and after the storing, transferring the charges from the column lines to the storage elements.

16. The method of claim 15, wherein said some of the pixel cells are associated with a common row line.

17. The method of claim 15, wherein the act of transferring comprises:

simultaneously transferring the charges to the storage elements.

18. The method of claim 15, wherein the act of storing comprises:

sequentially driving the column lines with sampled indications of a video signal.

19. The method of claim 15, wherein the act of storing comprises:

simultaneously driving the column lines with sampled indications of a video signal.

20. A method for updating a portion of a display, comprising:

selecting columns of pixel cells that are associated with the portion;

selecting rows of pixel cells that are associated with the portion; and for each selected row of pixel cells, storing charges on column lines associated with the selected columns of pixel cells, isolating the column lines from the selected row of pixel cells and after the storage, using the charges to update the selected row.

21. The method of claim 20, wherein the act of using comprises:

transferring the charges from the column lines to storage elements associated with the selected row.

22. The method of claim 21, wherein the act of transferring comprises:

simultaneously transferring the charges to the storage elements.

23. The method of claim 20, further comprising:

basing the selection on a video signal capable of indicating the portion.

24. A system comprising:

an array of display pixel cells arranged in rows and columns;

column lines associated with the columns of pixel cells;

storage elements associated with a row of the pixel cells; and decoding circuitry adapted to:

store charges on the column lines, isolate the column lines from the storage elements during the storage of the charges on the column lines; and after the storage, transfer the charges from the column lines to the storage elements.

25. The system of claim 24, wherein the decoding circuitry is further adapted to:

simultaneously transfer the charges from the column lines to the storage elements.

26. The system of claim 24, wherein the decoding circuitry is further adapted to:

sequentially drive the column lines with sampled indications of a video signal.

27. A display comprising:

an array of display pixel cells arranged in rows and columns;

column lines associated with the columns of pixel cells; and a circuit to:

select the columns of the pixel cells that are associated with portion of the display, select the rows of the pixel cells that are associated with the portion, for each selected row of pixel cells, store charges on column lines associated with the selected columns of pixel cells;

isolate the column lines from the selected row of pixel cells, and after the storage, use the charges to update the selected row.

28. The display of claim 27, wherein the circuit transfers the charges from the column lines to storage elements associated with the selected row.

29. The method of claim 28, wherein the circuit simultaneously transfers the charges to the storage elements.

* * * * *